United States Patent [19]

Abdul-Rahman et al.

[11] 4,152,245

[45] May 1, 1979

[54] SEPARATION OF ROCK SOLIDS FROM HEAT CARRIERS IN AN OIL SHALE RETORTING PROCESS

[75] Inventors: Yahio A. K. Abdul-Rahman; Herbert B. Wolcott, Jr., both of Plano, Tex.

[73] Assignee: Atlantic Richfield Company, Los Angeles, Calif.

[21] Appl. No.: 856,884

[22] Filed: Dec. 2, 1977

[51] Int. Cl.[2] ..... C10G 1/02; C10B 53/06

[52] U.S. Cl. ..... 208/11 R; 209/474

[58] Field of Search ..... 208/11 R; 209/138, 139 R, 209/474, 475, 476

[56] References Cited

U.S. PATENT DOCUMENTS

| | | | |
|---|---|---|---|
| 2,561,396 | 7/1951 | Matheson | 209/474 |
| 2,586,818 | 2/1952 | Harms | 209/474 |
| 2,864,763 | 12/1958 | Schulman et al. | 209/138 |
| 3,774,759 | 11/1973 | Weintraub et al. | 209/474 |
| 3,803,021 | 4/1974 | Rahman | 208/11 R |

*Primary Examiner*—Herbert Levine
*Attorney, Agent, or Firm*—M. David Folzenlogen

[57] ABSTRACT

In an oil shale retorting process, hot heat-carrying solids are cycled to a retort zone to mix with and retort crushed oil shale, thereby producing gas, oil products, and a mixture of heat-carrier solids and spent shale solids. The spent shale solids contain some rock solids which have a heavier particle weight than the heat-carrier solids. The heat-carrier solids are separated and recovered from the spent shale for recycle through the process. In one stage of the separation procedure, a mixture of heat-carrier solids and rock solids is fed to a gas fluidized bed classifier which is constructed and operated in a way such that rock solids are preferentially separated from the heat-carrier solids. The separation stage is especially suited to spherically-shaped heat-carrier solids in a size range between about 0.14 centimeters (0.055 inch) and 1.27 centimeters (0.5 inch) and having a surface area of between 10 and 150 square meters per gram.

6 Claims, 3 Drawing Figures

SEPARATION OF ROCK SOLIDS FROM HEAT CARRIERS IN AN OIL SHALE RETORTING PROCESS

BACKGROUND OF THE INVENTION

This invention relates to an improved oil shale retorting process and a separation system for removing rock solids from heat-carrier solids which are cycled in the retorting process. The rock solids are removed in a gas fluidized classifier especially useful for the relationship between rock solids and heat-carrier solids.

It has been proposed to use heat-carrying spherically-shaped solids to retort the solid carbonaceous organic matter (commonly called kerogen) in oil shale to produce petroleum products. The spherically-shaped solids are heated and these hot heat carriers are mixed with crushed oil shale. The heat from the hot heat-carrying solids helps to convert the kerogen in the oil shale to oil and gas and produces a mixture of heat-carrier solids and spent shale solids. The heat-carrier solids of a significant size are separated from the spent shale solids so that the heat-carrier solids may be heated and cycled through the retorting process. In a process of the type described in U.S. Pat. No. 3,844,929, the heat-carrying solids are special porous pellets having a surface area of at least 10 square meters per gram and a size ranging from approximately 0.04 centimeter (0.055 inch) to approximately 1.27 centimeters (0.5 inch). In this process, a combustible deposition is formed on the pellets. This deposition is burned to reheat the pellets. In the process, it is especially important that the pellets are recovered from the spent shale and that only a small amount of spent shale be retained with the pellets. In U.S. Pat. No. 3,803,021, a combination elutriation-size screening separating system is provided. In co-pending application Ser. No. 749,505, filed Dec. 10, 1976 and now U.S. Pat. No. 4,118,309, entitled "Separation and Recovery of Heat Carriers in an Oil Shale Retorting Process," and owned by a common assignee, a continuously restored inclined surface is provided for assisting in separation of heat-carrier solids from the spent shale solids.

For the most part, the previously suggested separating processes will remove 95 percent or more of the undesired spent shale solids. The remaining spent shale solids contain rock solids. Some of the remaining rock solids will disintegrate on being cycled through the retorting process. But some of the remaining rock solids are not disintegrated and this type of rock solids will accumulate in the system if they are not removed. These rock solids are a hard, temperature resistant, spherically-shaped gravel-like rock which are difficult to remove by the previously suggested systems.

SUMMARY OF THE INVENTION

Mined oil shale, which contains solid carbonaceous and other mineral matter and which has been crushed and may have been preheated, is retorted in a retort zone with hot, heat-carrying solids. Retorting the oil shale produces gas and oil products, which are recovered, and a mixture of the heat-carrier solids and spent shale solids containing some rock solids.

After the oil shale is retorted, the mixture of solids is passed through one or more separation stages so that most of the spent shale solids are separated and disposed of.

In at least one stage, which is preferably preceded by one or two other separation stages, a mixture of heat-carrier solids and particulate spent shale being at least partially comprised of rock solids having a particle weight heavier than the heat-carrier solids is fed to a gas fluidized bed classifier. The classifier is operated and constructed in a manner such that gas causes the solids in the mixture to move relative to each other and in a manner such that the solids may be removed from the classifier in two streams at preselected spaced apart points. A first stream of solids enriched in rock solids is removed at a point between the points of entry of the mixture of solids and of the gas. A second stream of solids containing less rock solids than the mixture of solids fed to the classifier is removed at a point above the point of entry of the mixture of solids. As a result, the accumulation or build up of rock solids is prevented as the heat-carrier solids are cycled in the retorting process.

Upon removal from the classifier, the heat-carrier solids are received and collected by appropriate means so that the heat-carrier solids may be eventually reheated and recycled to a retort zone; and the rock solids are received and collected by appropriate means for eventual disposal, that is, the separated rock solids are not cycled to the retort zone.

The improved oil shale retorting process of this invention is especially advantageous for a retorting process wherein the spherically-shaped solids of a significant size are comprised of spherically-shaped pellets or heat carriers in a size range between approximately about 0.14 centimeter (0.055 inch) and 1.27 centimeters (0.5 inch) and have a surface area of between 10 and 150 square meters per gram.

DETAILED DESCRIPTION OF THE INVENTION

In an oil shale retorting process using hot heat-carrier solids to heat the oil shale, the heat carriers must be separated from the spent retorted mineral matter in the oil shale so that the heat carriers may be reheated and recycled to the retort. This invention relates to a separation system for this type of retorting process. The separation system is directed specifically to certain rock solids and will be employed with other solids separation facilities wherein the heat-carrier solids are separated from the spent processed shale solids.

The separation system is particularly advantageous to a porous pellet retorting process for reasons herein made apparent. For example, these pellets have a size and specific gravity such that it is difficult to remove certain spent oil shale mineral matter from the pellets. The pellets act both as a heat carrier and as a fuel carrier. Recycle and build up of spent shale solids tends to throw the retorting system out of balance and to interfere with proper deposition of the fuel on the pellets and proper gas and solids flow.

Figure 1:
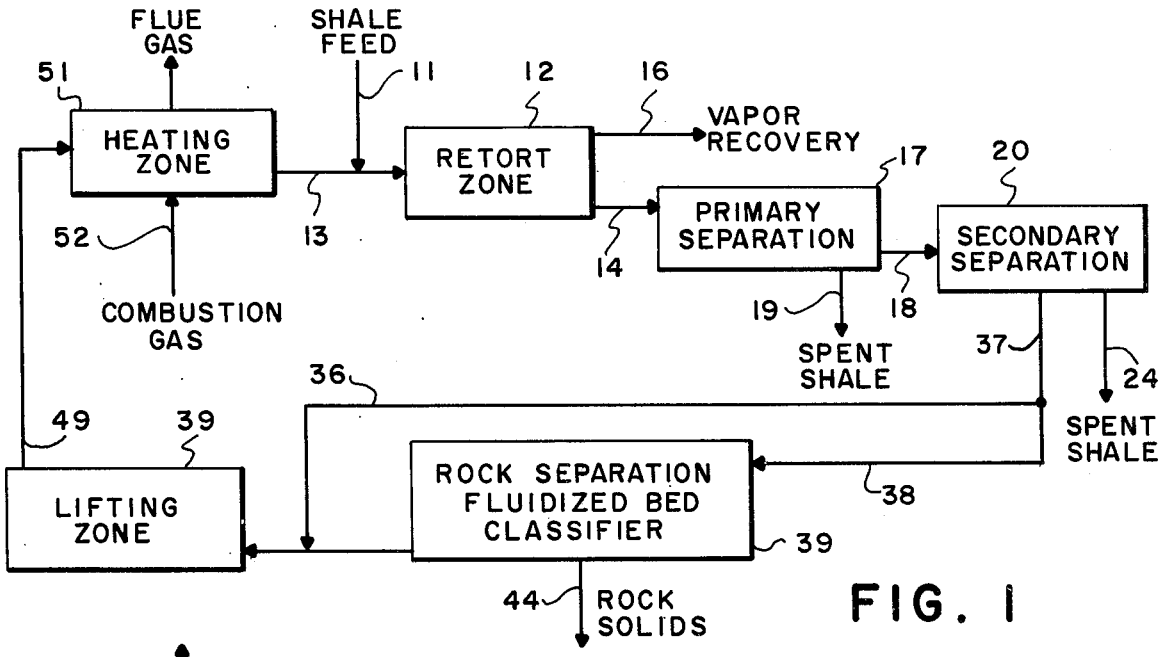
FIG. 1 is a schematic flowsheet of a retorting process employing a fluidized bed classifier separation stage.
Figure 2:
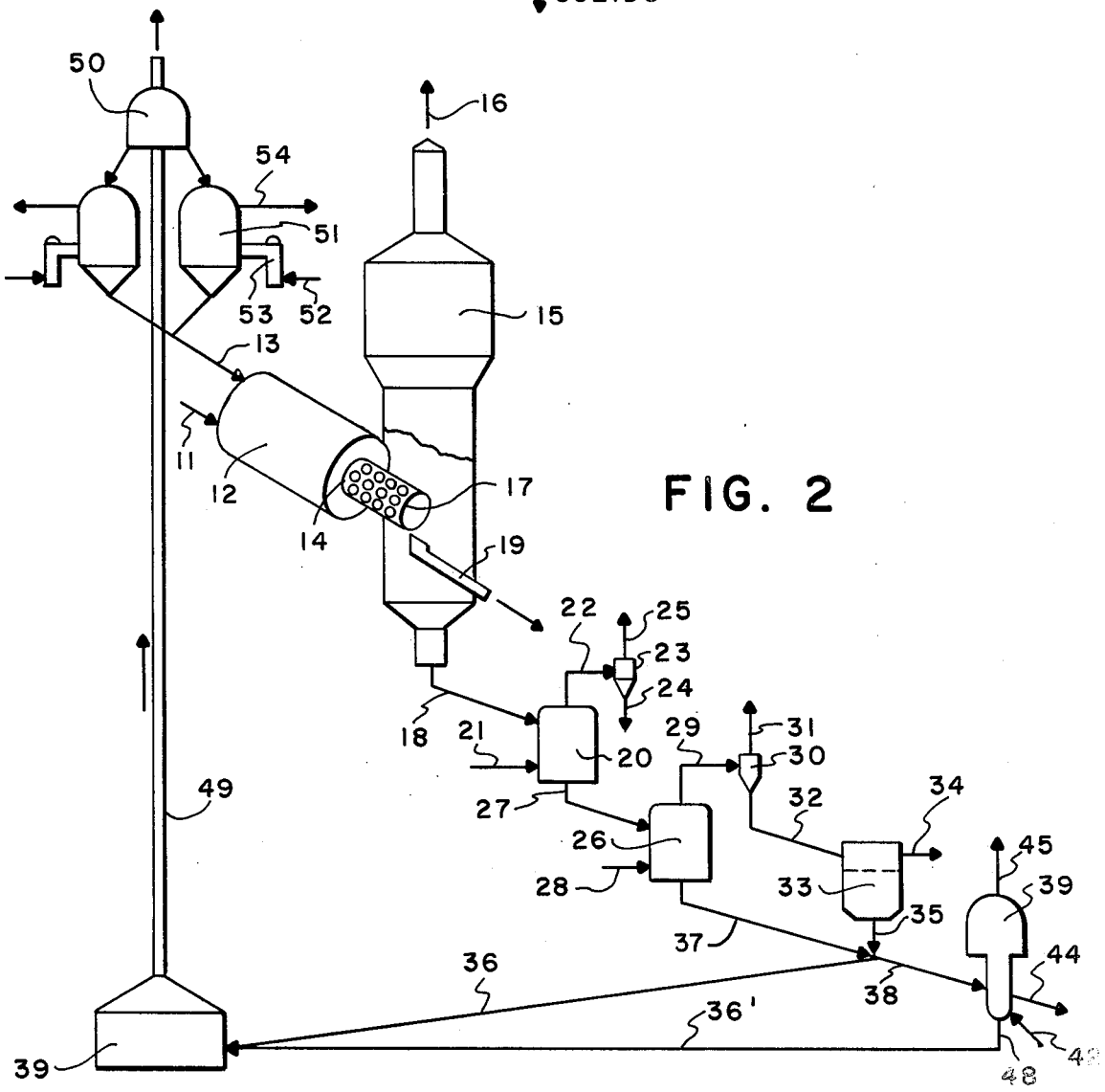
FIG. 2 is a partly schematical, partly diagrammatical flow illustration of a retorting process using porous, spherically-shaped heat carriers and a fluidized bed classifier separation stage after two other separation stages.

Although FIGS. 1 and 2 primarily illustrate a porous pellet retorting process, these figures also serve to illustrate any retorting processes using heat-carrier solids. In these retorting processes, mined oil shale crushed by a particle diminution process to a suitable size is fed by way of shale inlet line 11 to retort zone 12 where oil shale is mixed with hot heat-carrying solids. These particulate solids are fed by way of gravity or other mechanical means to the retort zone by way of heat-carrier inlet pipe 13. The heat carriers and the shale feed stock could be fed to the retort zone by way of a common retort zone inlet.

Chunks of mine run oil shale may be quite large; therefore, it is necessary to crush the mined oil shale in a retorting process using hot, solid heat carriers. Crushing facilitates uniform mixing, contact and heat transfer between the shale feed stock and the hot heat carriers. The degree of crushing usually depends on an economic balance between the cost of crushing and the advantages to be gained by crushing. Generally, in a retorting process of this nature, the shale feed stock is crushed to a size of about a nominal 1.27 centimeters (0.5 inch) with the resulting shale particles being both larger and smaller than 1.27 centimeters.

The crushed oil shale may or may not be preheated before it is fed to the retort zone. If the shale feed stock is preheated, the temperature of the feed stock will usually not exceed 316° C. (600° F.). The shale feed stock will usually be fed by way of a metered weight controller system so that the proper ratio of heat carriers to raw shale is maintained.

Retort zone 12 is any sort of retort wherein the crushed oil shale feed stock and hot heat carriers are intimately mixed. The retort zone illustrated in FIG. 2 is an inclined retorting drum that causes the oil shale and heat carriers to undergo a sort of tumbling action. This sort of retort is herein referred to as a rotating retort zone. This type of retort zone is flexible over a wide range of process conditions and is especially suited to retorting with hot, porous, heat-carrying, particulate solids of the type hereinafter described. This type of retort zone causes rapid solid-to-shale heat exchange which in turn causes flashing and pyrolysis of the kerogen in the oil shale to gas and oil vapors. It also provides efficient separation of these petroleum products from the solids in a way that lessens redeposition of the petroleum vapors and minimizes dilution of the product vapors by extraneous undesirable retorting gases. The rotating retort allows a high shale throughput and product yield per unit retort volume. It provides for increased control over residence time and prevents overcoking and agglomeration of the retort solids. It also causes the solids to move through the retort in a manner which eventually aids separation of the heat-carrier solids from the spent mineral matter in the oil shale. When the hereinafter mentioned porous heat-carrying pellets are used, the rotating retort zone facilitates formation of a more uniform controlled amount of combustible carbon-containing deposition on the internal surface area of the pellets.

The hot heat-carrying solids are fed to the retort zone at a temperature ranging between 538° C. (100° F.) and 816° C. (1500° F.) which is significantly higher than the designed retort temperature within the retort zone. The quantity of hot, heat-carrying solids is controlled so that the heat carrier-to-shale feed stock ratio on a weight basis is such that the sensible heat in the heat carriers is sufficient to provide a significant portion (for example, at least fifty percent) of the heat required to heat the shale feed stock from its retort zone feed temperature to the designed retort temperature. The feed stock feed temperature is the temperature of the oil shale after preheating, that is, the temperature of the shale upon entry into the retort zone. The average retort temperature ranges between about 454° C. (850° F.) and about 649° C. (1200° F.), depending on the nature of the shale feed stock, the ratio of heat carriers to oil shale, the product distribution produced in the retort zone, heat losses and the like. The preferred range of heat carrier-to-shale feed stock ratio is between 1 and 3 on a weight basis.

The retorting process of this invention includes a separation stage for removal of rock solids. This separation stage is best suited to use with the separation system described in U.S. Pat. No. 3,803,021, and co-pending application Ser. No. 749,505. In these processes, the heat-carrier solids have a sphericity factor, for the most part, of at least 0.9, that is, 0.9 or greater. The sphericity factor is the external or geometric surface area of a sphere having the same volume as the spherically-shaped solid divided by the external surface area of the spherically-shaped solid.

The heat-carrier solids are made up of materials, such as ceramics, alumina, or silica alumina, which are not consumed in the retorting process. They are sufficiently wear or breakage resistant and heat resistant to maintain enough of their physical characteristics under the conditions employed in the process to satisfy the requirements of the retorting process.

The oil shale retorting process of this invention is especially advantageous for a retorting process of the type described in U.S. Pat. No. 3,844,929, that is, a retorting process wherein the hot heat-carrying solids are comprised of spherically-shaped, subdivided or particulate solid heat carriers having a minimum relatively high internal surface area of 10 square meters per gram and higher in a size range of between about 0.14 centimeters (0.055 inch) and 1.27 centimeters (0.5 inch). The preferred size range is between about 0.14 centimeters (0.055 inch) and 0.953 centimeters (0.375 inch). Preferably, the average surface area of the heat carrier pellets will be between 10 and 150 square meters per gram. The surface area is the average effective surface area of the heat carrier pellets as they enter the retort zone. The surface area may be determined by the conventional nitrogen absorption method.

In the porous pellet process, the pellets act both as a heat carrier and as a fuel carrier. In the retort zone, a combustible carbon-containing deposition or residue is formed or deposited on the relatively high internal surface area of the porous pellets if the effective surface area of the pellets has not already been covered with all of the deposition that it can sustain. The amount of combustible deposition formed or deposited on the pellets upon one passage through the process is sufficient upon combustion to provide at least fifty percent of the heat required to reheat the pellets. The amount of combustible deposition deposited during the retorting stage is on an average less than 1.5 percent by weight of the pellets, for example, 0.8 to 1.5 percent by weight. The pellet surface area, size, and amount coact with other retort process conditions to accomplish the desired amount of combustible deposition and petroleum product distribution. If the surface area of the pellets is less than 10 square meters per gram, either too little total deposition will be formed or the burning of the deposition will not be sufficient to provide a major portion of the heat required to heat the pellets to the desired temperature and to carry out the retorting phase of the retorting process. Since the pellets bear this fuel and are relatively costly, it is particularly important that there be a low loss of porous pellets with the spent shale. It is also particularly important that mineral matter in the spent shale not be allowed to accumulate as the pellets cycled through the retorting process. Recycled spent shale mineral matter increases the amount of solids that must be reheated by burning the fuel deposited on the pellets.

Although the porous pellets are sufficiently wear and heat resistant to prevent undue loss of surface area, they do undergo size reduction as they are cycled through the retorting system. This attrition combined with pellet makeup increases the size range of the pellets. Particular effort is made to retain and recover pellets above about 0.15 centimeter (0.06 inch). Finer grain pellets may be retained and recovered, but no special effort is made to retain these finer grain pellets. On a once through basis, as much as five percent by weight of spent mineral matter in the oil shale is likely to be present in the pellet stream that is retained and recycled. Some of this spent shale mineral matter is strong rock matter, for example, silicate rock. This rock matter accumulates if it is not removed. In this invention, the rock solids are separated from the pellets. The separation system of this invention is, therefore, particularly useful for the porous pellet retorting process.

Returning now to FIGS. 1 and 2, it will be noted that the oil shale feed stock and the hot, heat-carrying solids move concurrently through retort zone 12. In the retort zone, the hotter heat carriers admix with the cooler crushed shale feed stock upon their being charged into the retort zone. The shale particles are rapidly heated by sensible heat transfer from the heat carriers to the shale. As a result, water in the shale is vaporized and kerogen or carbonaceous matter in the shale is decomposed, vaporized, and cracked into gaseous and condensible oil fractions, thereby forming a valuable vaporous effluent including gas, oil vapors, and super heated steam. Pyrolysis and vaporization of the carbonaceous matter in the oil shale leaves particulate spent shale in the form of the spent mineral matrix matter of the oil shale and a relatively small amount of unvaporized or coked organic carbon-containing material. In a typical retort system, there will be approximately one metric ton of spent shale for every one to three metric tons of heat carriers. The spent shale and the heat carriers are intimately mixed and form a mixture of solids which will be separated as hereinafter described.

If the retort system utilizes spherically-shaped porous pellets, as previously described, a combustible carbon-containing deposition or residue will be formed or deposited on the pellets during the retort phase of the process.

The mixture of heat-carrier solids and shale moves through the retort zone toward retort exit 14 and the gaseous and vaporous effluent containing the valuable hydrocarbon materials separates from the mixture. The residence time of the shale in the retort zone will depend upon the system and the flow or movement characteristics of the mixture. Shale residence times vary, but they are usually on the order of about three to about twenty minutes.

The mixture of heat carriers and spent shale solids exits from retort zone 13 by way of retort exit 14 into recovery chamber 15 where the gaseous and vaporous products are collected overhead and passed to overhead retort products line 16. The product vapors exit the retort zone at a temperature which depends upon the process and which usually lies between 400° C. (750° F.) and 621° C. (1117° F.). The product vapors are usually subjected to hot dust separation and the dust thus separated is collected and may be combined and handled with other spent shale for proper disposal.

The mixture of heat-carrier solids and spent shale solids exits the retort zone at a temperature which also depends upon the process, but which usually lies within the aforementioned temperature range for the vaporous products. The mixture of particulate solids from the retort zone is then passed through a separation and recovery system. As previously mentioned, in a porous pellet retorting process, the pellets in a significant size range, which covers the particles which are 0.15 centimeters (0.06 inch) in size and larger, are recovered for recycle to the retort zone.

The separation and recovery system for handling the solids mixture will include one or more stages, at least one stage of which is the rock solids separation stage of this invention. This is illustrated in FIGS. 1 and 2 wherein the mixture of solids exiting the retort zone through retort exit 14 are passed through a first separation stage represented by revolving screen or trommel 17 extending into product recovery chamber 15. In this first separation stage, spent shale particles and agglomerates larger than the heat-carrier solids are at least partially removed from the mixture. As shown, this is accomplished by openings or apertures sized to pass the heat-carrier solids and spent shale solids of the same or smaller size than the heat-carrier solids and to screen out the larger size spent shale solids. Most of the spent shale and the heat-carrier solids flow through the first separation stage, that is, through the openings in trommel 17 and drop to the bottom of recovery chamber 15 to exit via exit line 18. As shown, spent shale, mineral matter, and agglomerates too large to pass through the openings in the trommel pass outward through exit 19 for spent shale disposal. This prescreening or initial first separation stage of the spent shale larger than the spherically-shaped solids is optimal and may be delayed until a later or final stage of the separation system is needed. A rotating retort makes initial screening for removal of the larger size solids easier and more efficient.

Also as shown, the first separation stage for removal of larger size solids is followed by a second separation stage for removal of spent shale solids. As shown, the spent shale and heat-carrier solids remaining after the first separation stage pass through exit line 18 at a relatively high temperature, for example, between 400° C. (750° F.) and 621° C. (1117° F.) where the remaining mixture of particulate solids are passed by suitable means of conveyance to a second separation stage for removing at least a portion of the spent shale solids. The second separation stage may be any system for removing spent shale solids from the heat-carrier solids, such as, for example, screening, elutriation, the screening-elutriation steps of U.S. Pat. No. 3,803,021, the inclined surface of co-pending application Ser. No. 749,505, or a combination thereof.

The second separation stage illustrated in FIG. 2 is the combination of screening and elutriation described in U.S. Pat. No. 3,803,021. In this second separation stage, a significant portion of the spent shale solids are removed in a multi-stage combined gas elutriation-screening separation system. The elutriators will be operated at a velocity high enough to remove a portion of the spent shale, but not high enough to damage or remove heat-carrier solids above a certain size. The internal operation and design of gas elutriators is well known; however, it may be noted that, in addition to the properties of the particles, the elutriation velocity of particular particles depends on the elutriator design including such factors as free board height, bed height and weight, gas type and velocity, column diameter and cross-sectional area, and transport disengaging height. In this process, it is highly desirable that the elutriating gas be maintained at a temperature above 400° C. In the porous pellet process, it is essential that elutriation be accomplished in a way which retains the desired amount of combustible deposition on the pellets; consequently, the elutriating gas must be a noncombusting gas, that is, a gas that will not burn the combustible deposition on the pellets.

The mixture of heat-carrier solids and spent shale solids passes from the retort zone through the recovery chamber via line 18 into first elutriation zone 20 where the mixture is subjected to gas elutriation with a non-combustion supporting gas entering the elutriation zone by way of inlet 21. The elutriation velocity of the gas is below the elutriation velocity of the smallest size heat carriers, for example, below about 0.06 inch pellets (plus 14 screen size). The elutriated spent shale solids are separated as an overhead stream from first elutriation zone 20 by way of overhead line 22, thereby leaving a mixture of remaining heat-carrier solids and spent shale solids. The elutriated spent shale is separated from the elutriating gas in first overhead separator 23, for example, a cyclone, scrubber, or the like, to be disposed of by way of line 24, and the clean elutriating gas may be passed through gas exit-inlet line 25 to the next or second elutriation zone 26, to be recycled into the first elutriation zone, to the fluidized bed hereinafter described, or to a heat carrier lift system, whichever is preferred.

The mixture of remaining heat-carrier solids and spent shale solids leaves the first elutriation zone as a lower stream through lower exit line 27 and is passed to another or second elutriation zone where the mixture is subjected to gas elutriation with gas entering line 28, which may be the same gas as was used in the first zone, or a fresh gas, or a combination of the two with or without additional heating. The elutriation velocity in the second zone is higher than the elutriation velocity of the preceding or first elutriation zone and is at least high enough to elutriate the smallest size heat-carrier solids in the mixture. Spent shale solids larger than the elutriated heat-carrier solids will also be elutriated and carried out in overhead stream 29 with the elutriated heat-carrier solids. This leaves remaining particulated solids that are a mixture of heat-carrier solids and spent shale solids which now contain heat-carrier solids larger than prior to elutriation because the smaller heat carriers have been removed.

The elutriated heat-carrier solids and spent shale solids are separated from the elutriating gas in a second overhead separator 30, and the separated elutriating gas may be passed through gas exit-inlet line 31 to a next or third elutriation zone, to be recycled to the first or second elutriation zone, to the fluidized bed hereinafter described, or to a heat carrier lift system.

The separated mixture of elutriated heat-carrier solids and spent shale solids is passed through line 32 to screening unit 33 which is any sort of efficient screening or trommel-like separating system operating to retain the spent shale larger than the heat carriers and to pass and allow recovery of the heat-carrier solids and any small size spent shale solids of equal or smaller size than the heat-carrier solids. As mentioned previously, larger sized spent shale solids are present since the elutriation velocity of the spent shale is less than the elutriation velocity of the heat-carrier solids. The larger size retained spent shale solids are passed through exit 34 to disposal. The heat-carrier solids are passed through exit line 35 and recovered for eventual passage to heat carrier return line 36'.

The remaining particulated solids containing heat-carrier solids and spent shale solids are passed from second elutriation zone 26 leaving the zone as a lower stream through line 37, which for simplicity is shown as flowing into either heat carrier return line 36 or classifier feed line 38.

If the circumstances warrant, the remaining mixture of heat-carrier solids and spent shale solids in line 37 may be subjected to another gas elutriation stage at a higher elutriation velocity than the preceding elutriation stage with the elutriated product being screened as before. Generally, only three stages of elutriation will be required, but if needed, the elutriation-screening steps can be repeated until the desired degree of spent shale separation is achieved.

It is desirable that at least 95 percent by weight of the heat-carrier solids are recovered. At the same time, at least 75 percent by weight of the spent shale in the solids mixture from the retort zone is separated in the separation stages of the process from the mixture and disposed. The separated spent shale solids may be disposed as waste or used for some other purposes. In most retorting processes using solid heat carriers, it is desirable and sometimes even necessary to separate more than 75 percent of the spent shale. For example, in a porous pellet process, it is desirable that 80 percent or more of the spent shale be separated from the solids mixture from the retort.

It has been found that most of the remaining spent shale solids are composed of carbonate minerals that will be disintegrated upon subsequent cycles of the heat carriers through the retort system. But some of the remaining spent shale solids, for example, 5 to 20 percent are silicate rock that will not be disintegrated or degraded and will accumulate in the retort system. In one experiment, the silicate rock solids had the sieve analysis shown in Table 1 as compared to the sieve analysis of some porous pellets.

TABLE 1

| Screen Size | % Silicate Rock | % Pellets |
|---|---|---|
| − 3 + 6 | 17.6 | 7.3 |
| − 4 + 5 | 21.8 | 28.0 |
| − 5 + 6 | 20.4 | 24.2 |
| − 6 + 8 | 29.6 | 22.3 |
| − 8 + 10 | 10.6 | 12.2 |
| Total | 99.6 | 99.0 |

The silicate rock solids were well rounded "river gravel" with a shape similar to the pellets. The rock solids had a specific gravity of 2.6 while the pellets had a specific gravity of 1.8 to 2. The rock solids were, therefore, at least partially comprised of solids having a heavier particle weight than the heat-carrier solids.

The accumulation of silicate rock solids should be reduced to a minimum. As a result, as illustrated, it is essential that at least a portion of this remaining mixture of heat-carrier solids and spent shale solids be treated for further separation in a gas fluidized bed classifier of the type illustrated in FIG. 3. The amount of remaining mixture that is treated in this manner will depend on the amount of spent shale rock solids remaining in the mixture. In some instances, it may be necessary to only treat a portion of the remaining mixture to achieve the necessary degree of spent shale separation. As shown, part of the remaining mixture passes by way of line 36 to lifting system 39 where the heat-carrier solids are lifted to a reheating zone.

Figure 3:
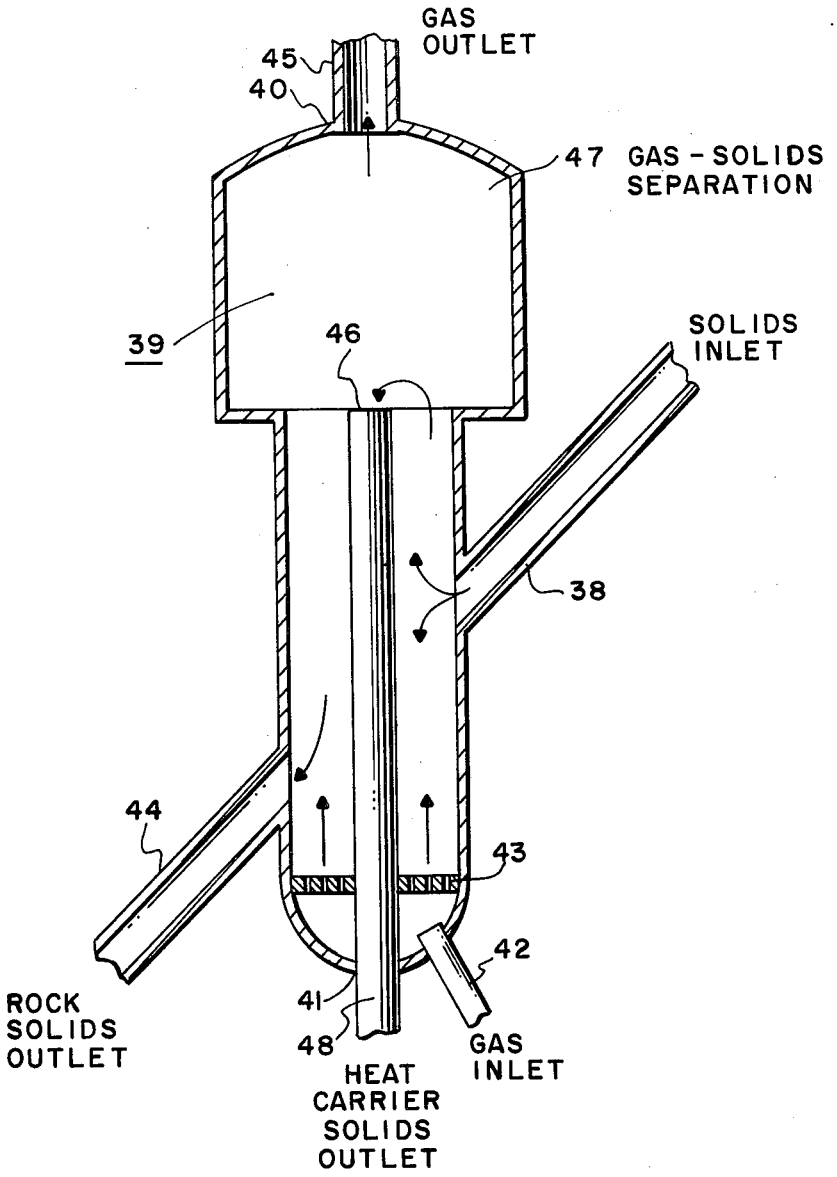
FIG. 3 is a sectionalized, side view of the fluidized bed classifier showing the necessary relative location of the points of entry of the gas and mixture of solids and the points of removal of the gas, rock solids, and heat-carrier solids.

A portion of the remaining mixture from the previous separation stage or elutriation system is fed by way of classifier feed line 38 to a fluidized bed classifier 39 which is illustrated in FIG. 3. The classifier has upper end 40 and lower end 41 and the mixture of solids is fed at a first point between the upper and lower ends at a rate sufficient to maintain a column of solids in the classifier. Fluidizing gas is fed by way of gas line 42 to the classifier at a second point which is below the point where the mixture of solids enters the fluidized bed and is near the lower end of the bed. The fluidizing gas is passed through gas distributor 43 upward through the classifier at a velocity sufficient to cause heat-carrying solids and spent shale rock solids to move relative to each other. It is desirable that the fluidizing gas be maintained at an elevated temperature and that it be a noncombusting gas. The fluidizing gas rate is adjusted to rate of solids feed, temperature, pressure, solids distribution, gas composition, and the like, to maintain a proper bed height and cause the silicate rock solids to separate from the heat-carrier solids. In a test using porous pellet beads and 10 percent river gravel of the same size range as that shown in Table 1, separation of the silicate rock solids occurred near minimum fluidization levels.

As a result of fluidization below maximum fluidization rates, a first stream of solids is removed from the classifier at a third point by way of rock outlet line 44. As shown, the rock out line is located at a point below the point of entry of the mixture of the solids to the classifier and above the point where the fluidizing gas enters the classifier. The stream of solids leaving the classifier by way of rock outlet line 44 has a higher average concentration by weight of rock solids than the concentration of rock solids in the mixture of heat-carrier solids and spend shale solids entering the classifier.

The gas flows upward through the classifier and exits through gas exit line 45. The heat-carrier solids move upward to heat carrier outlet point 46 where classifier has enlarged cross section 47 where the linear velocity of the fluidizing gas is decreased and is no longer sufficient to move the solids. The heat carrier outlet point is above the point of entry of the mixture of solids into the classifier. The stream of solids passes downward through classifier exit line 48. This stream of solids has less concentration by weight of rock solids than the concentration of rock solids in the mixture of heat-carrier solids and spent shale solids fed to the classifier.

The heat-carrier solids leaving the classifier are cycled back through heat carrier return line 36' to a heating zone to be reheated. In most retorting processes using recycled solid heat carriers, the heat carriers are lifted to a heating zone which is close to the retort zone so that the hot heat carriers may be fed to the retort zone without a significant loss of heat. The heat carriers may be lifted by gas, ball elevator, conveyor belt, or the like.

As shown in FIG. 2, lift system 39 for the heat-carrier solids is a gas system where the solids collected from the separation system are gas lifted through return line 49 to surge hopper 50 for collecting the heat-carrier solids. If the heat-carrier solids are porous pellets bearing a combustible fuel deposition, the gas used to lift the pellets will usually be a noncombustion supporting gas.

The heat-carrier solids are fed by gravity or other suitable means to heating zone 51 which may be any suitable heating zone for reheating the solids to the desired temperature, that is, a temperature which enables the hot heat carriers to be fed to the retort at a temperature ranging between 538° C. (1000° F.) and 816° C. (1500° F.).

In FIG. 2, heating zone 51 is a pellet deposition burning zone. As previously mentioned, in the porous pellet retorting process, the pellets bear a combustible deposition which was absorbed or deposited during the retorting stage of the process. This combustible deposition is burned in heating zone 51 to provide at least 50 percent or more of the heat required to reheat the pellets to the temperature required to effect retorting of the oil shale. The combustible deposition is burned in a manner similar to the way that cracking catalyst particles are regenerated. The burning process is designed to avoid excessive heating of the porous pellets so as to avoid excessive reduction in the effective surface area of the pellets to less than 10 square meters per gram. A progressive bed burner with a gas flow of about 1 to 2 feet per second is preferred. A combustion supporting gas, for example, air, a mixture of air and fuel gas generated in the process, or flue gas with the desired amount of free oxygen, is blown into the deposition burning-heating zone at a temperature at which the deposition on the porous pellets is ignited by way of combustion gas inlet 52. Steam may also be used to control burning provided that the steam does not excessively reduce the surface area of the porous solids. The combustion supporting gas may be preheated in heaters 53 by burning some of the gases produced in the process to reheat the porous pellets to the minimum ignition temperature. The quantity of combustion supporting gas, for example, about 4.5 kilograms (10 lbs.) to about 6.8 kilograms (15 lbs.) of air per 0.45 kilograms (1 lb.) of deposition affects the total amount of deposition burned and the heat generated by such burning and, in turn, the temperature of the pellets. The bulk density of the pellets is about 18.2 kilograms (40 lbs.) to 22.7 kilograms (50 lbs.) per 0.85 cubic meters (1 cubic foot). The specific heat of the porous pellets varies between about 0.2 and 0.3 gram-calorie per gram per degree Celsius. The gross heating value of the carbon-containing deposition is estimated to be about 8,333 to 10,000 gram-calories per gram (15,000 to 18,000 BTU per lb.). The amounts of carbon dioxide and carbon monoxide produced in the flue gases created by burning the deposition on the porous pellets indicate the amount of combustion supporting gas required or used and the amount of carbon-containing deposition not burned. Generally, it is not desirable to attempt to free the pellets of deposition. Other factors taken into consideration during burning of the deposition are the porosity, density, and size of the pellets, the burner chamber size and bed size, residence burning time, the desired temperature for the heat carriers, heat losses and inputs, the heat carrier and oil shale feed rates to the retort zone, dust content, and the like. The residence burning time will usually be rather long and up to about 30 to 60 minutes. Combustion of the deposition should be controlled in a manner which does not heat the porous spherically-shaped pellets to above 816° C. (1500° F.). The hot flue gases generated in the deposition burning zone may be removed by burning zone exit line 54 and used to preheat cool raw shale feed stock or for heat transfer in some other part of the oil shale facility. Of course, additional fuel material or gases may be used to supplement the burning of the deposition on the porous spherically-shaped pellets if this is necessary.

The hot temperature burning conditions in the heating zone tend to cause carbonate spent shale particles carried into the zone to undergo more complete retorting, size attrition or splintering, thereby helping to prevent buildup of unseparated spent shale as the spherically-shaped bodies are cycled in the process.

Reheating of the heat-carrier solids produces a continuous stream of hot heat carriers in the desired temperature range for recycle by way of retort inlet line 13 either by gravity and/or mechanical means to retort zone 12. As previously indicated, the rate of passage of the reheated heat carrying solids from the heating zone will be metered or controlled in conventional manner to eventually provide the optimum heat carrier-to-oil shale feed stock ratio in the retort zone.

The foregoing description of preferred embodiments of the retorting process of this invention described an improvement in oil shale retorting processes wherein a fluidized bed classifier separation stage prevents build up of durable silicate rock solids. Reasonable variations and modifications are practical within the scope of this disclosure without departing from the spirit and scope of the claims of this invention. For example, the classifier could be used separately or included as part of the lift pipe system, elutriation system, or heating zone.

The embodiments of the invention in which an exclusive property or privilege is claimed are defined as follows:

1. In a method for retorting crushed oil shale containing carbonaceous organic matter and mineral matter wherein oil shale is retorted by contacting said oil shale with hot heat-carrier solids in a retort zone to produce gas and oil products and a mixture of said heat-carrier solids and spent shale solids, said spent shale solids being at least partially comprised of rock solids having a heavier particle weight than said heat-carrier solids, the improvement comprising:

a. feeding a mixture of said heat-carrier solids and said rock solids at a first point to a fluidized bed classifier having an upper end and a lower end, said mixture being fed at a rate sufficient to maintain a column of solids in said classifier;

b. injecting gas into said classifier at a second point, said second point being below said first point and being nearer to said lower end than said first point;

c. passing said gas upward through said classifier at a velocity sufficient to cause the solids in said classifier above said second point to move relative to each other;

d. removing a first stream of solids from said classifier at a third point, said third point being below said first point and being nearer to said lower end than said first point, said third point being above said second point and being further from said lower end than said second point, said first stream of solids having a higher average concentration of said rock solids than said mixture of solids fed to said classifier in said step (a);

e. removing a second stream of solids from said classifier at a fourth point, said fourth point being above said first point and being further away from said lower end than said first point, said second stream of solids having less average concentration of said rock solids than said mixture of solids fed to said classifier in said step (a), and f. removing gas from said classifier at a fifth point, said fifth point being above said fourth point.

2. The method according to claim 1 wherein the heat-carrier solids are spherically-shaped pellets being in a size range between approximately about 0.14 centimeter and 1.27 centimeters and having a surface area of between 10 and 150 square meters per gram.

3. The method according to claim 2 wherein said heat-carrier solids are in a size range between approximately about 0.14 centimeter and 0.953 centimeter.

4. A method for retorting crushed oil shale containing carbonaceous organic matter and mineral matter using heat-carrier solids which are recovered for reuse in the retorting method, which method comprises:

a. feeding crushed oil shale and heat-carrier solids to a retort zone, said heat-carrier solids being at a retort zone inlet temperature of between 538° C. and 816° C. and in a quantity such that the sensible heat in said heat-carrier solids is sufficient to provide at least fifty percent of the heat required to heat said crushed oil shale from its retort zone feed temperature to a retort zone outlet temperature of between 400° and 621° C.;

b. retorting in said retort zone gas and oil products from said crushed oil shale, thereby forming a mixture of heat-carrier solids and spent shale solids, said spent shale solids being at least partially comprised of rock solids having a heavier particle weight than said heat-carrier solids;

c. recovering said gas and oil products generated by retorting said crushed oil shale;

d. passing said mixture of heat-carrier solids and spent shale solids from said retort zone to a solids separation and recovery zone, at least one stage of said separation and recovery zone comprising:

(1) feeding a mixture of said heat-carrier solids and said rock solids at a first point to a fluidized bed classifier having an upper end and a lower end, said mixture being fed at a rate sufficient to maintain a column of solids in said classifier;

(2) injecting gas into said classifier at a second point, said second point being below said first point and being nearer to said lower end than said first point;

(3) passing said gas upward through said classifier at a velocity suffficient to cause the solids in said classifier above said second point to move relative to each other;

(4) removing a first stream of solids from said classifier at a third point, said third point being below said first point and being nearer to said lower end than said first point, said third point being above said second point and being further from said lower end than said second point, said first stream of solids having a higher average concentration of said rock solids than said mixture of solids fed to said classifier in said step (1);

(5) removing a second stream of solids from said classifier at a fourth point, said fourth point being above said first point and being further away from said lower end than said first point, said second stream of solids having less average concentration of said rock solids than said mixture of solids fed to said classifier in said step (1), and (6) removing gas from said classifier at a fifth point, said fifth point being above said fourth point.

5. The method according to claim 4 wherein the heat-carrier solids are spherically-shaped pellets being in a size range between approximately about 0.14 centimeter and 1.27 centimeters and having a surface area of between 10 and 150 square meters per gram.

6. The method according to claim 5 wherein said heat-carrier solids are in a size range between approximately about 0.14 centimeter and 0.953 centimeter.

* * * * *